US006584917B2

(12) United States Patent
Long

(10) Patent No.: US 6,584,917 B2
(45) Date of Patent: Jul. 1, 2003

(54) DEVICE FOR CONTROLLING THE ROTATION OF A SHAFT

(76) Inventor: Dennis L. Long, 2161 Thornapple River Dr., Grand Rapids, MI (US) 49546

( * ) Notice: Subject to any disclaimer, the term of this patent is extended or adjusted under 35 U.S.C. 154(b) by 60 days.

(21) Appl. No.: 09/877,475

(22) Filed: Jun. 8, 2001

(65) Prior Publication Data

US 2002/0043188 A1 Apr. 18, 2002

Related U.S. Application Data

(60) Provisional application No. 60/210,188, filed on Jun. 8, 2000.

(51) Int. Cl.[7] ..... A47B 9/00

(52) U.S. Cl. ..... 108/147; 188/77 W

(58) Field of Search ..... 108/147, 146, 108/144.11; 248/123.11; 188/77 W; 267/275; 74/526, 523, 528, 545, 582, 589, 590

(56) References Cited

U.S. PATENT DOCUMENTS

| | | | | | |
|---|---|---|---|---|---|
| 3,064,766 | A | * | 11/1962 | Hainizeski | 188/77 W |
| 4,278,032 | A | * | 7/1981 | Kritske | 108/6 |
| 4,457,406 | A | | 7/1984 | Porter | |
| 4,600,240 | A | | 7/1986 | Suman et al. | |
| 5,010,983 | A | | 4/1991 | Kitamura | |
| 5,186,285 | A | | 2/1993 | van der Werff | |
| 5,197,704 | A | | 3/1993 | Kitamura | |
| 5,219,045 | A | | 6/1993 | Porter et al. | |
| 5,354,028 | A | | 10/1994 | Kitamura | |
| 5,441,129 | A | | 8/1995 | Porter et al. | |
| 5,568,843 | A | | 10/1996 | Porter et al. | |
| 5,706,739 | A | * | 1/1998 | Shaheen et al. | 108/146 |
| 5,718,406 | A | | 2/1998 | Long | |
| 5,794,470 | A | | 8/1998 | Stringer | |
| 6,026,755 | A | * | 2/2000 | Long | 108/147 |
| 6,062,148 | A | * | 5/2000 | Hodge et al. | 108/147 |
| 6,119,605 | A | * | 9/2000 | Agee | 108/147 |
| 6,378,446 | B1 | * | 4/2002 | Long | 107/147 |

* cited by examiner

*Primary Examiner*—Janet M. Wilkens
(74) *Attorney, Agent, or Firm*—Mary M. Moyne; Ian C. McLeod

(57) ABSTRACT

The device (10) prevents a shaft (110) from rotating. When mounted on the shaft extending between the movement mechanisms (106) of a workstation (100), the device prevents the movement mechanisms from raising or lowering the work surface (102). A pair of fixed hubs (20 and 22) are fixably mounted on the shaft. A rotatable hub (24) is rotatably mounted on the shaft spaced between the fixed hubs. First and second wrap springs (28 and 30) extend between each of the fixed hubs and the rotatable hub. A pair of wrap springs are force fit over the fixed hubs and rotatable hub. The device also includes an anti-release mechanism which prevents release of the device when an additional force is applied to the work surface such that the work surface is out-of-balance.

32 Claims, 9 Drawing Sheets

DEVICE FOR CONTROLLING THE ROTATION OF A SHAFT

CROSS REFERENCE TO RELATED APPLICATION

This application claims the benefit of U.S. Provisional Application Ser. No. 60/210,188 filed on Jun. 8, 2000.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates to a device for mounting on a shaft which can prevent the rotation of the shaft. In particular, the present invention relates to a device which mounts on a rotatable shaft which is part of the movement mechanism for a work surface of a workstation. The device prevents rotation of the shaft when the device is in the lock position. The device also prevents rotation of the shaft when the load on the work surface is out-of-balance.

(2) Description of the Related Art

The related art has shown various devices for controlling the rotation of a shaft in either direction using the frictional force of a wrap spring. Illustrative are U.S. Pat. Nos. 5,010,983; 5,197,704 and 5,354,028 all to Kitamura.

Kitamura '983 describes a device for locking the rotation of a shaft in both directions using a device having a single spring mounted around a fixed shaft and a movable shaft. Further, the device does not prevent unlocking or rotation of the shaft when an out-of-balance load is applied to the shaft.

Kitamura '704 describes an angle adjusting device for adjusting an angle of indication of a display device. The device includes a rotatable axis having small diameter end portions with a large diameter center portion spaced therebetween and a pair of fixed axis rotatably supporting the small diameter portions. A pair of coil springs having the same winding direction are mounted on the center large diameter portion and the pair of fixed axis.

Kitamura '028 describes a device for adjusting the angle of indication of a display device. The device includes a rotatable axis rotatably supported by a fixed axis with at least one (1) coil spring closely mounted over the rotatable axis and having an end fastened on the fixed axis.

Also of interest are U.S. Pat. Nos. 4,457,406; 5,219,045; 5,441,129 and 5,568,843 all to Porter et al and 5,794,470 to Stringer which show a mechanism lock having a rod axially movable through a lock housing, with one (1) or more coil springs tightly wound about the rod and axially fixed to the housing so as to normally grip the rod against axial or longitudinal movement through the housing. A release is provided for partially unwinding the coil springs to release the rod for axial movement relative to the lock housing.

U.S. Pat. No. 4,600,240 to Suman et al describes a unidirectional friction clutch for a headrest. The headrest is rigidly secured to an axle. The axle is pivotally mounted within a U-shaped fixed bracket. The spring clutch includes a coil spring which extends over the axle. One (1) end of the spring is anchored to the fixed bracket and the opposite end is anchored to the headrest. The spring is wound around the axle to prevent clockwise rotation of the headrest since clockwise rotation tends to tighten the grip of the spring around the axle. Movement of the headrest in a counter-clockwise position expends the spring which loosens the grip of the spring on the axle allowing the axle and headrest to move. Thus, this device only prevents rotation of the axle in one (1) direction. Further, the device does not prevent movement of the shaft when an out-of-balance load is applied to the headrest.

Only of minimal interest is U.S. Pat. No. 5,186,285 to van der Werff describes a device for controlling the rotation of a shaft in one (1) direction in response to a continuous torque being applied to the shaft. A control member is used to wrap and unwrap the spring. The device is not intended to control rotation of a shaft in both directions.

None of the above devices prevent unlocking of the device or rotation of the shaft when an out-of-balance load is applied to the shaft.

There remains the need for a device which prevents the rotation of a shaft in either direction when in the lock position and which can not be moved into the unlock position if an out-of-balance force is applied to the shaft.

SUMMARY OF THE INVENTION

In one (1) embodiment, the device is mounted on a shaft or axle extending between the legs of a counterbalance table or workstation. When in the active or lock position, the device prevents the shaft from rotating which prevents the movement mechanisms in the legs from raising or lowering the work surface. The device also includes an anti-release mechanism which prevents release of the device by the main release lever when an out-of-balance force is applied to the work surface such that the work surface is out-of-balance. The additional force can be applied in either direction. The force can be in the form of an additional load or less load on the work surface.

In one (1) embodiment the device includes a housing plate and a U-shaped mounting bracket with the shaft extending through the legs of the mounting bracket. A pair of fixed hubs are fixably mounted on the shaft between the legs of the mounting bracket. One of the fixed hubs is mounted adjacent the inner side of each of the legs of the mounting bracket. The fixed hubs have a first portion and a second portion. Each portion preferably has a cylindrical shape. The fixed hubs are mounted on the shaft such that the first portion of the hub is adjacent the leg of the mounting bracket and the second portion extends inward along the shaft. A rotatable hub is rotatably mounted on the shaft spaced between the fixed hubs. The rotatable hub has a first end portion, a second portion and a center portion. The rotatable hub is mounted on the shaft such that the first and second end portions extend outward toward the fixed hubs. The center portion of the rotatable hub includes an extension which extends downward toward and through an opening in the center portion of the mounting bracket. A spring wire is connected at one end to the extension. The other end of the spring wire is fixably mounted. A first and second wrap spring extend between each of the fixed hubs and the rotatable hub and are mounted over the second portions of the fixed hubs and end portions of the rotatable hub. The diameters of the second portion of the fixed hubs and the end portions of the rotatable hub are preferably only slightly greater than the inner diameter of the wrap springs such that the wrap springs are force fit over the second portions of the fixed and rotatable hub. The first end of each wrap spring adjacent the fixed hubs extend through the first and second slots in the housing plate. An anti-release mechanism is mounted on the front side of the center portion of the housing plate adjacent the slots. The anti-release mechanism preferably includes a first and second release lever and a sliding release block. The levers are pivotally mounted to the housing plate between the slots. The levers have opposed first and second ends with the pivot point located between the ends. The first release lever is mounted such that the first end of the release lever extends across the first slot and a top edge of the first end of the first release lever is in contact with the first end of the first wrap spring. The second end of the first release lever is connected to a spring which is connected at the other end to the housing plate. The spring acts to bias the first release lever into the release position. The first end of the second release lever extends adjacent the first end of the first release lever. The second end of the second release lever extends across the second slot in the housing plate and the bottom edge of the second end is in contact with the first end of the second wrap spring. The second lever is connected to one end of a spring. The other end of the spring is connected to the housing plate. The spring acts to bias the second release lever into the release position.

The sliding, release block is mounted adjacent the first ends of the release levers and is connected by a cable to the main release lever. The main release lever is preferably adjacent the front of the work surface where it is easily accessible by the user. The bottom of the slidable release block is provided with a biasing means such as a spring to bias the release block into the initial unreleased position.

Initially, the sliding release block is in the lock position and the release levers are in the release position. In this position, the wrap springs are wrapped tightly around the first portion of the fixed hubs to prevent rotation of the hubs and shaft. Thus the work surface is in a fixed position. To move the work surface, the main release lever is pulled. When the lever is pulled, the release block moves upward and contacts the first ends of the levers which acts to pivot the levers into contact with the first ends of the first and second wrap springs. The levers act on the first ends of both wrap springs in opposite directions to unwind both springs, thus allowing the fixed hubs and shaft to rotate in either direction.

The device prevents a user from releasing the device and allowing movement of the work surface when an additional load or less load (out-of-balance load) is applied to the work surface and the work surface which causes the work surface to be out-of-balance. This prevents the work surface from moving too quickly in either direction due to an extra out-of-balance load. The device preferably prevents movement of the work surface in the direction of force applied by the out-of-balance load. When an out-of-balance load is applied to the work surface a torque is applied to the shaft attempting to rotate the shaft, fixed hubs, the wrap springs and rotatable hub. The spring wire connected to the extension of the rotatable hub resists and counteracts the torque attempting to rotate the shaft and the rotatable hub and increases the amount of torque needed to rotate the rotatable hub, shaft and wrap springs. However, upon application of a torque or load on the work surface, the rotatable hub begins to rotate until the rotatable hub is in contact with the edge of the opening in the center portion of the mounting bracket. As the rotatable hub rotates, the wrap springs rotate and the first ends of the wrap springs extending through the slots in the housing plate move and pivot the release levers. When the amount of torque tending to rotate the shaft reaches a set amount the force applied to the work surface exceed a certain amount, the wrap spring have rotated such a distance as to have moved the levers such that the first ends of the levers adjacent the release block are in the non-release position. Only one (1) lever is moved, depending on the direction the shaft is rotated which depends on the direction of the out-of-balance load applied to the work surface. When the main release lever is pulled, the release block slides upward, and does not contact the lever in the non-release position. Thus, the release block will not operate to unwind the wrap spring to release the shaft in one (1) direction depending on the direction of the out-of-balance force. Consequently, the work surface can not be moved in the direction of the out-of-balance force.

In one (1) embodiment, an out-of-balance indicator is also connected to the rotatable hub. The end of the out-of-balance indicator opposite the rotatable hub is located adjacent an opening in the center stretcher panel of the table. When an out-of-balance load is applied to the work surface and the rotatable hub is rotated, the end of the indicator moves up or down to show the user that the table is out-of-balance and the direction in which the extra load is being applied. This is useful when a user changes the amount of load that on the work surface. The indicator allows the user to adjust the movement mechanisms to accommodate the change in load on the work surface.

The present invention relates to a device for controlling rotation of a shaft, which comprises: a fixed hub fixably mounted on the shaft; a rotatable hub rotatably mounted on the shaft; a wrap spring releasably mounted around the fixed hub and the rotatable hub; a stop mounted adjacent the rotatable hub to limit rotation of the rotatable hub; a release lever movably mounted adjacent the wrap spring such that the release lever is in contact with the wrap spring wherein movement of the wrap spring moves the release lever from a release position to a non-release position; and a release block slidably mounted adjacent the release lever wherein when the release lever is in the release position and the release block is moved from a lock position into an unlock position, the release block contacts the release lever and moves the release lever such that the release lever moves the wrap spring so as to release the wrap spring from around the fixed hub, wherein when the release lever is in the non-release position and the release block is moved from the lock position, the release block does not contact the release lever to release the wrap spring from around the fixed hub.

Further, the present invention relates to a device for controlling rotation of a shaft, which comprises: a first fixed hub fixably mounted on the shaft; a second fixed hub fixably mounted on the shaft; a rotatable hub rotatably mounted on the shaft; a first wrap spring mounted around the first fixed hub and the first rotatable hub; a second wrap spring mounted around the second fixed hub and the second rotatable hub; a first stop mounted adjacent the first rotatable hub to limit rotation of the first rotatable hub in a first direction; a second stop mounted adjacent the second rotatable hub to limit rotation of the second rotatable hub in a second direction opposite from the first direction; a release lever movably mounted adjacent the first and second wrap springs such that the release lever is in contact with the first wrap spring and the second wrap spring, wherein movement of the first wrap spring moves the release lever from a first release position to a first non-release position and wherein movement of the second wrap spring moves the release lever from a second release position to a second non-release position; and a release block slidably mounted adjacent the release lever wherein when the release lever is in the first release position and the release block is moved from a lock position into an unlock position, the release block will contact the release lever and will move the release lever such that the release lever will move the first wrap spring so as to release the first wrap spring, and wherein when the release lever is in the second release position and the release block is moved from the lock position into the unlock position, the release block will contact the release lever and will move the release lever so that the release lever will move the second wrap spring so as to release the second wrap spring, wherein when the release lever is in the first non-release position and the release block is moved from the lock position into the unlock position, the release block will not contact the release lever to release the first wrap spring and wherein when the release lever is in the second non-release position and the release block is moved from the lock position into the unlock position, the release block will not contact the release lever to release the second wrap spring.

Still further, the present invention relates to a device for controlling movement of a work surface of a workstation, the workstation having at least one movement mechanism having a shaft which rotates during movement of the work surface of the workstation, which comprises: a housing plate mounted to the workstation adjacent the shaft having a front side and a back side and a first and second opening; a mounting bracket having first and second ends and mounted on the back side of the housing plate such that the first and second openings are spaced between the first and second ends of the mounting bracket wherein the first and second ends of the mounting bracket have first and second holes through which the shaft is rotatably mounted; a first fixed hub fixably mounted on the shaft between the ends of the mounting bracket; a second fixed hub fixably mounted on the shaft between the ends of the mounting bracket; a rotatable hub rotatably mounted on the shaft between the ends of the mounting bracket; a first wrap spring having first and second ends and mounted at the first end on the first fixed hub and fixably mounted at the second end on the rotatable hub wherein the first end of the first wrap spring extends through the first opening in the housing plate; a second wrap spring having first and second ends and mounted at the first end on the second fixed hub and fixably mounted at the second end to the rotatable hub wherein the first end of the second wrap spring extends through the second opening in the housing plate; a first stop mounted adjacent the rotatable hub to limit rotation of the rotatable hub in a first direction; a second stop mounted adjacent the rotatable hub to limit rotation of the second rotatable hub in a second direction; a first release lever having first and second ends pivotably mounted on the front side of the housing plate so that the second end of the first release lever is adjacent the first opening in the housing plate and is in contact with the first end of the first wrap spring wherein movement of the first end of the first wrap spring moves the first release lever from a release position to a non-release position; a second release lever having a first end and a second end and pivotably mounted on the front side of the housing plate so that the first end of the second release lever is adjacent the second opening in the housing plate and is in contact with the second end of the second wrap spring wherein movement of the first end of the second wrap spring moves the second release lever from a release position to a non-release position; a release block slidably mounted on the front side of the housing plate adjacent the second end of the first release lever and the second end of the second release lever wherein when the first release lever is in the release position, and the release block is moved from a lock position to an unlock position, the release block will contact the second end of the first release lever and will pivot the first release lever such that the first release lever will unwrap the first end of the first wrap spring so as to release the first wrap spring from around the first fixed hub, and wherein when the second release lever is in the release position and the release block is moved from the lock position to the unlock position, the release block will contact the second end of the second release lever and will pivot the second release lever so that the second release lever will unwrap the second end of the second wrap spring so as to release the second wrap spring from around the second fixed hub, wherein when the first release lever is in the non-release position, and the release block is moved from the lock position to the unlock position, the release block will not contact the first release lever to release the first wrap spring and wherein when the second release lever is in the non-release position and the release block is moved from the lock position to the unlock position, the release block will not contact the second release lever to release the second wrap spring.

The substance and advantages of the present invention will become increasingly apparent by reference to the following drawings and the description.

DESCRIPTION OF THE PREFERRED EMBODIMENTS

Figure 1:
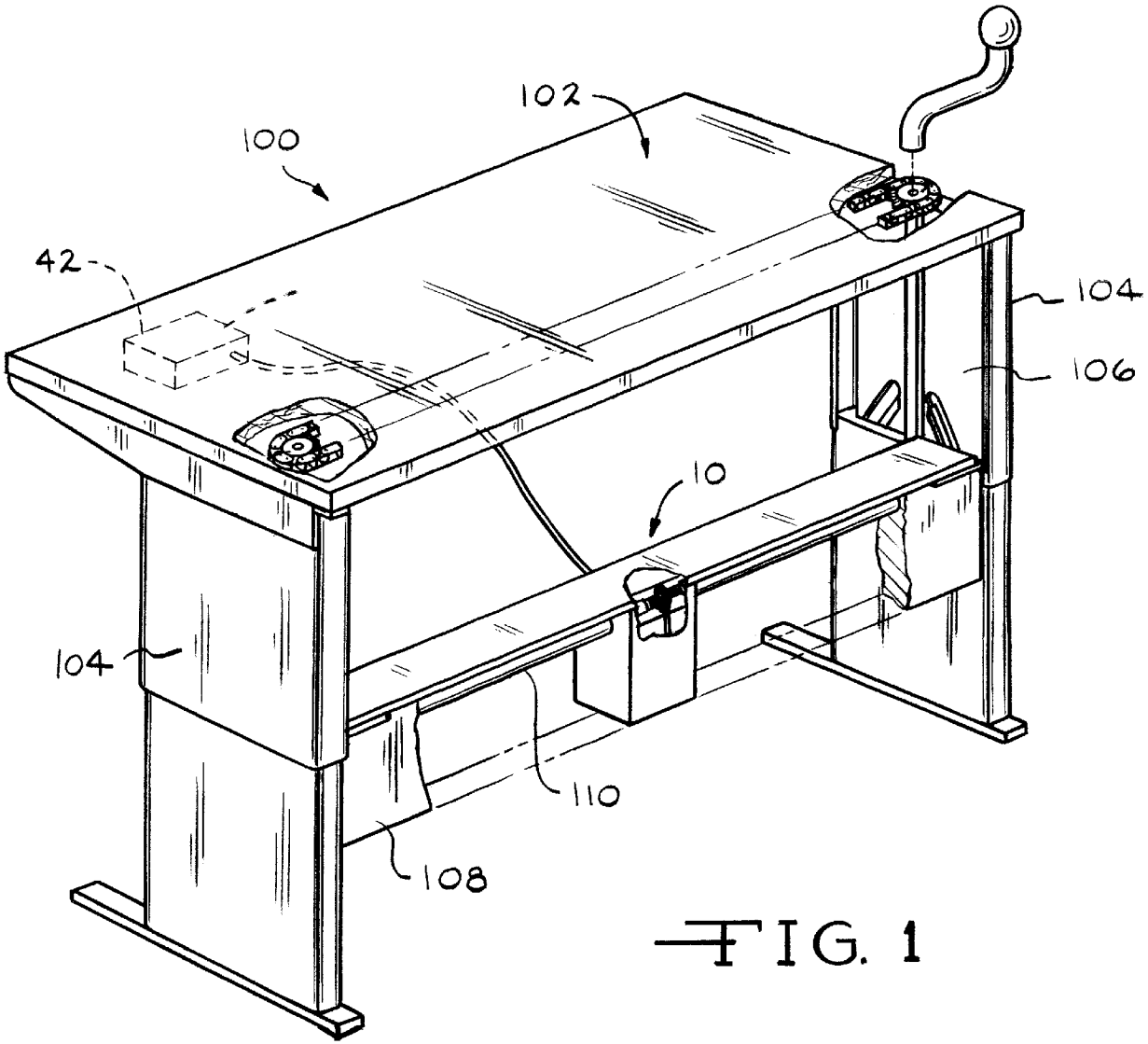
FIG. 1 is a perspective view of a counterbalance workstation 100 showing the rotation control device 10 mounted on the alignment shaft 110 between the counterbalance mechanisms 106 located in the legs 104 of the work surface 102.

The device 10 of the present invention is intended to be mounted on a shaft or axle 110 extending between movement mechanisms 106 mounted in the legs 104 of a table or workstation 100 (FIG. 1). In one (1) embodiment, the movement mechanism 106 is a counterbalance mechanism similar to that described in U.S. Pat. No. 5,718,406 to Long which is incorporated herein by reference. In one (1) embodiment, the shaft 110 extends between the counterbalance mechanism 106 in one leg 104 to a movement mechanism 106 in the other leg 104. The second movement mechanism 106 does not necessarily have to be a counterbalance mechanism. The primary purpose of the shaft 110 is to ensure that the movement mechanisms 106 are aligned simultaneously to raise or lower the work surface 102. In the preferred embodiment, the device 10 is mounted on the shaft 110 between the legs 104 of the workstation 100 and is enclosed within the center kick plate or stretcher panel 108 of the workstation 100. It is understood that the device 10 can be mounted on the workstation 100 by any means. The specific shape and size of the mounting bracket 14 would depend on the specific use of the device 10.

Figure 2:
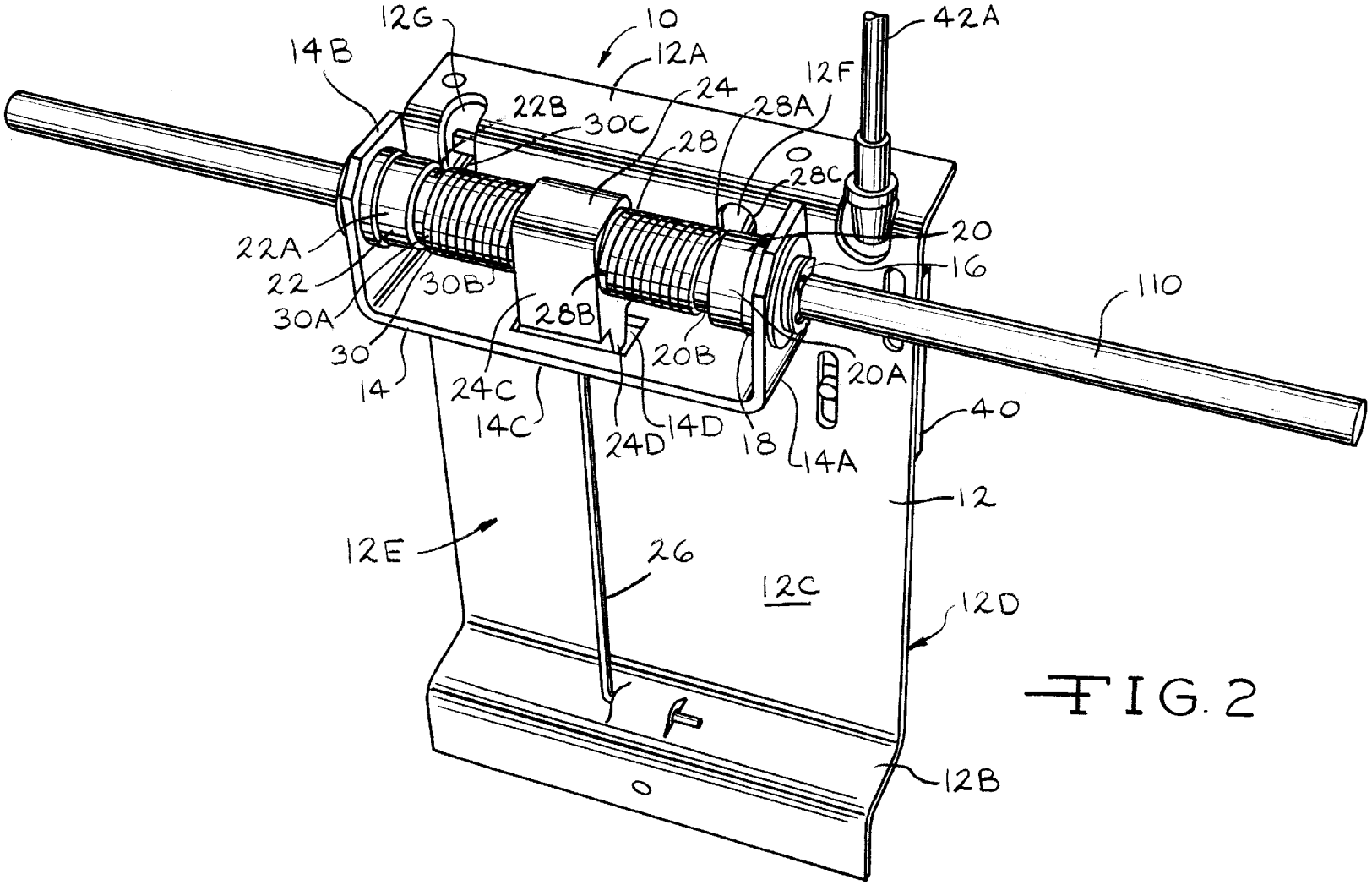
FIG. 2 is a rear perspective view of the device 10 mounted on the shaft 110 showing the back side 12E of the housing plate 12, the mounting bracket 14, the first and second wrap springs 28 and 30 and the rotatable hub 24.

In one (1) embodiment, the device 10 includes a housing plate or bracket 12 which allows for mounting the device 10 in the kick plate 108 of the workstation 100. The housing plate 12 has a top flange 12A and a bottom flange 12B with a center portion 12C extending therebetween. The top flange 12A and bottom flange 12B extend outward from the center portion 12C in opposite directions. The top flange 12A preferably extends outward in a direction away from the back side 12E of the center portion 12C. The bottom flange 12B preferably extends outward in a direction away from the front side 12D of the center portion 12C. A lip extends outward from the side of the top flange 12A in a direction away from the bottom flange 12B and parallel to the center portion 12C. The center portion 12C has a front side 12D and a back side 12E with first and second slots or openings 12F and 12G extending part of the distance between the top and bottom flanges 12A and 12B adjacent the top flange 12A. A U-shaped mounting bracket 14 is preferably secured to the back side 12E of the center portion 12C adjacent the top flange 12A. The mounting bracket 14 has a first leg or end 14A and a second leg or end 14B extending upward from a floor or center portion 12C (FIG. 2). The mounting bracket 14 is mounted on the housing plate 12 such that the center portion 12C extends perpendicular to the back side 12E of the housing plate 12 and the legs 104 of the mounting bracket 14 extend upward from the center portion 12C toward the top flange 12A of the housing plate 12. The pair of legs 104 have holes (not shown) through which the shaft 110 extends. A pair of locking washers or spring clips 16 are mounted on the shaft 110 adjacent the outer side of the legs 104 to hold the shaft 110 in place on the mounting bracket 14. Each of the holes is provided with a flange bearing 18 to enable the shaft 110 to rotate in the hole. The center portion 14C of the mounting bracket 14 has an opening 14D spaced between the legs 104.

A first and second fixed hub 20 and 22 having a first portion 20A and 22A and a second portion 20B and 22B with a center bore extending therebetween are mounted on the shaft 110. The shaft 110 extends through the center bore of the first and second fixed hub 20 and 22 and the first and second fixed hub 20 and 22 are fixably mounted on the shaft 110 between the legs 104 of the mounting bracket 14. The first fixed hub 20 is mounted on the shaft 110 adjacent the inner side of the first leg 14A of the mounting bracket 14 and the second fixed hub 22 is mounted on the shaft 110 adjacent the inner side of the second leg 14B of the mounting bracket 14. In the preferred embodiment, the first portion 20A and 22A and second portion 20B and 22B are coaxial and are preferably constructed as a unitary piece. However, the fixed hubs 20 and 22 can be constructed of two (2) pieces. The diameter of the first portion 20A and 22A is preferably greater than the diameter of the second portion 20B and 22B. The fixed hubs 20 and 22 are mounted on the shaft 110 such that the first portion 20A and 22A of the fixed hub 20 and 22 is adjacent the leg of the mounting bracket 14 and the second portion 20B and 22B extends inward along the shaft 110.

A rotatable hub 24 is rotatably mounted on the shaft 110 spaced between the first and second fixed hubs 20 and 22. The rotatable hub 24 can be constructed as a unitary piece or as several pieces. The rotatable hub 24 includes first and second end portions 24A and 24B and a center portion 24C with a center bore extending therebetween. The first and second rotatable hub 24 is mounted on the shaft 110 such that the shaft 110 is rotatably mounted in the center bore and the first and the second end portions 24A and 24B extend outward along the shaft 110 toward the first and second fixed hubs 20 and 22, respectively. The first and second end portions 24A and 24B of the rotatable hub 24 preferably have a cylindrical shape. In the preferred embodiment, the diameter of the second portion 20B and 22B of the first and second fixed hubs 20 and 22 is essentially equal to the diameter of the first and second end portions 24A and 24B of the rotatable hub 24. The center portion 24C of the rotatable hubs 24 preferably has a size greater than the first and second end portions 24A and 24B of the rotatable hub 24. The center portion 24C of the rotatable hub 24 includes an extension 24D which extends downward toward and through the opening 14D in the center portion 14C of the mounting bracket 14. A spring wire 26 having opposed ends is connected at one end to the extension 24D of the rotatable hub 24 and extends downward toward the bottom flange 12B of the housing plate 12. The other end of the spring wire 26 is preferably fixably connected to the bottom flange 12B of the housing plate 12. It is understood that the second end of the spring wire 26 can be fixably attached to any portion of the housing plate 12 or workstation 100 below the mounting bracket 14. The spring wire 26 is mounted such as to be taut when the rotatable hub 24 is in the at rest, in balance, release position and to hold the rotatable hub 24 in the center of the opening 14D. The shaft 110, fixed hubs 20 and 22 and rotatable hub 24 are all coaxial. The fixed hubs 20 and 22 and the rotatable hub 24 are mounted in a minimally spaced apart relationship on the shaft 110 such that during rotation of the shaft 110, the fixed hubs 20 and 22 do not contact the rotatable hub 24.

Figure 9:
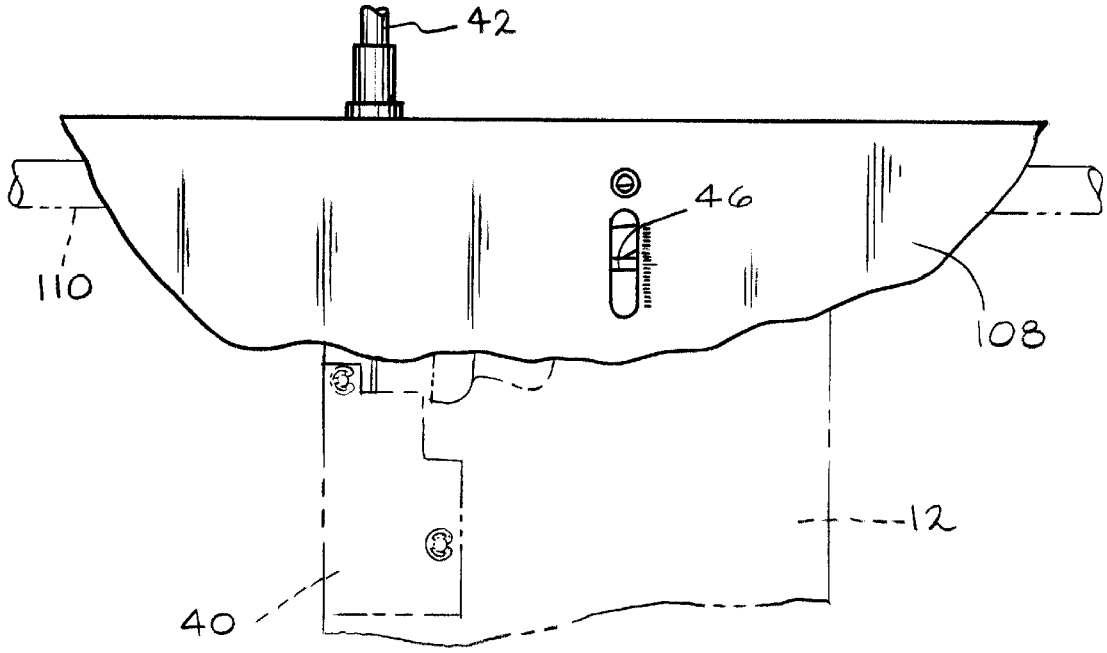
FIG. 9 is a partial, front view of the stretcher panel 102 showing the rotation control device 100 in phantom and showing the out-of-balance indicator 46 through an opening 14D in the stretcher panel 108.

An out-of-balance indicator 46 having opposed ends is mounted on one (1) end on the extension 24D of the rotatable hub 24. The end of the out-of-balance indicator 46 opposite the rotatable hub 24 is located adjacent an opening 14D in the stretcher panel 108 of the workstation 100 (FIG. 9). When an out-of-balance load is applied to the work surface 102 and the rotatable hub 24 is rotated, the end of the indicator 46 moved up or down to show the user that the work surface 102 is out-of-balance and to show the direction in which the out-of-balance load is being applied. This is useful when a user changes the amount of load that will be on the workstation 100. The indicator 46 allows the user to adjust the counterbalance mechanisms 106 to accommodate the change in load on the work surface 102.

A first and second wrap spring 28 and 30 having opposed first and second ends 28A and 30A and 28B and 30B are mounted around the second portions 20B and 22B of the fixed hubs 20 and 22 and the first and second end portions 24A and 24B of the rotatable hub 24. The first wrap spring 28 is preferably wrapped around the first fixed hub 20 and the rotatable hub 24 in the same direction as the second wrap spring 30 is wrapped around the second fixed hub 22 and the rotatable hub 24. The first end 28A of the first wrap spring 28 is preferably mounted around the second portion 20B of the first fixed hub 20 and the second end 28B of the first wrap spring 28 is mounted around the first end portion 24A of the rotatable hub 24. The first end 30A of the second wrap spring 30 is preferably mounted around the second portion 22B of the second fixed hub 22 and the second end 30B of the second wrap spring 30 is mounted around the second end portion 24B of the rotatable hub 24. The diameters of the second portion 20B and 22B of the first and second fixed hubs 20 and 22 and the first and second end portion 24A and 24B of the rotatable hub 24 are preferably only slightly greater than the inner diameter of the first and second wrap springs 28 and 30 such that the first and second wrap springs 28 and 30 are force fit over the second portion 20B and 22B of the first and second fixed hubs 20 and 22 and the end portions 24A and 24B of the rotatable hub 24. The tang 28C and 30C at the first end 28A and 30A of the first and second wrap springs 28 and 30 adjacent the first and second fixed hubs 20 and 22 extends through the first and second slots 12F and 12G, respectively in the housing plate 12. The first and second wrap springs 28 and 30 are preferably identical and are preferably coil springs.

An anti-release mechanism is mounted on the front side 12D of the center portion 12C of the housing plate 12 adjacent the slots 12F and 12G (FIGS. 3 to 6). The anti-release mechanism preferably includes a first release lever or arm 32 and a second release lever or arm 34 and a sliding release block 40. The first and second release levers 32 and 34 are pivotally mounted to the front side 12D of the housing plate 12 between the first and second slots 12F and 12G. The first and second release levers 32 and 34 have opposed first and second ends 32A, 34A and 32B and 32B with the pivot point located between the ends. In one (1) embodiment, the first and second release levers 32 and 34 share a pivot point and are mounted on top of each other such that the second release lever 34 is adjacent the housing plate 12 and the first release lever 32 is adjacent the side of the second release lever 34 opposite the housing plate 12. In one (1) embodiment, the first release lever 32 is mounted such that the second end 32B or 34B of the release lever 32 or 34 extends across the first slot 12F and a top edge of the first end 32A of the first release lever 32 is in contact with the tang 28C at the first end 28A of the first wrap spring 28. The second end 32B of the first release lever 32 preferably has an L-shape and extends downward from the top edge toward the bottom flange 12B of the housing plate 12. The first end 32A of the first release lever 32 is provided with a hook which connects to a first spring 36 which is connected at the other end to the housing plate 12. The spring 36 acts to bias the first release lever 32 into the release position. Although a spring is preferred, any type of biasing means can be used which applies a force on the first end 32A of the first release lever 32 tending to move the first end 32A of the first release lever 32 toward the bottom flange 12B of the housing plate 12 and the first release lever 32 into the release position. The second end 34B of the first lever 34 preferably does not extend to or beyond the second slot 12G in the housing plate 12. In one (1) embodiment, the second end 34B of the second release lever 34 has an essentially S-shape and extends adjacent the 32B of the first release lever 32. The shape of the second end 34B of the second release lever 34 is such that the second end 34B of the second release lever 34 does not obstruct the first slot 12F in the housing plate 12. The first end 34A of the second release lever 34 extends across the second slot 12G in the housing plate 12 so that the bottom edge of the first end 34A of the second release lever 34 is in contact with the tang 30C at the first end 30A of the second wrap spring 30. A hook is provided on the second release lever 34 between the pivot point and the first end 34A of the second release lever 34. The hook is connected to one end of a second spring 38. The other end of the second spring 38 is connected to the housing plate 12. The second spring 38 acts to bias the second release lever 34 into the release position. Although a spring is preferred, any type of biasing means can be used which applies a force on the second release lever 34 tending to move the first end 34A of the second release lever 34 toward the bottom flange 12B of the housing plate 12 and move the second release lever 34 into the release position.

In an alternative embodiment (not shown), a single release lever is pivotally mounted to the housing plate 12 such that the first end of the release lever extends across the first slot 12F in the housing plate 12 and the second end of the lever extends across the second slot 12G. The lever is mounted such that the top edge of the lever adjacent the first end is in contact with the tang 28C at the first end 28A of the first wrap spring 28 and the bottom edge of the release lever adjacent the second end is in contact with the tang 30C at the first end 30A of the second wrap spring 30.

In the one (1) embodiment, the release block 40 is slidably mounted on the front side 12D of the housing plate 12 adjacent the second ends 32B and 34B of the first and second release levers 32 and 34. The release block 40 can be slidably mounted on the center portion 12C of the housing plate 12 by any well known means. The release block 40 is connected by a cable 42A to the main release lever 42. The main release lever 42 is preferably mounted adjacent the front of the work surface 102 and is easily accessible by the user (FIG. 1). The release block 40 is mounted on the housing plate 12 such that when one (1) or both of the first or second release levers 32 or 34 are in the release position and the release block 40 is moved upward along and parallel to the front side 12D of the housing plate 12 toward the top flange 12A from the lock position to the unlock position, the release block 40 will contact the second end 32B and 34B of the first and second release levers 32 and 34 which are in the release position and pivot the release levers 32 and 34 to release the first and second wrap springs 28 and 30. In one (1) embodiment, the release block 40 has a stepped portion along one (1) side adjacent the second ends 32B and 34B of the release levers 32 and 34 such that the release block 40 is able to engage the second ends 32B and 34B of the first and second release levers 32 and 34 when the release block 40 is moved from the lock position to the unlock position and the release levers 32 and 34 are in the release position. The slidable release block 40 is provided with a biasing means 44 such as a spring, which applies a downward force on the release block 40 tending to bias the release block 40 into the lock position.

In Use

Figure 3:
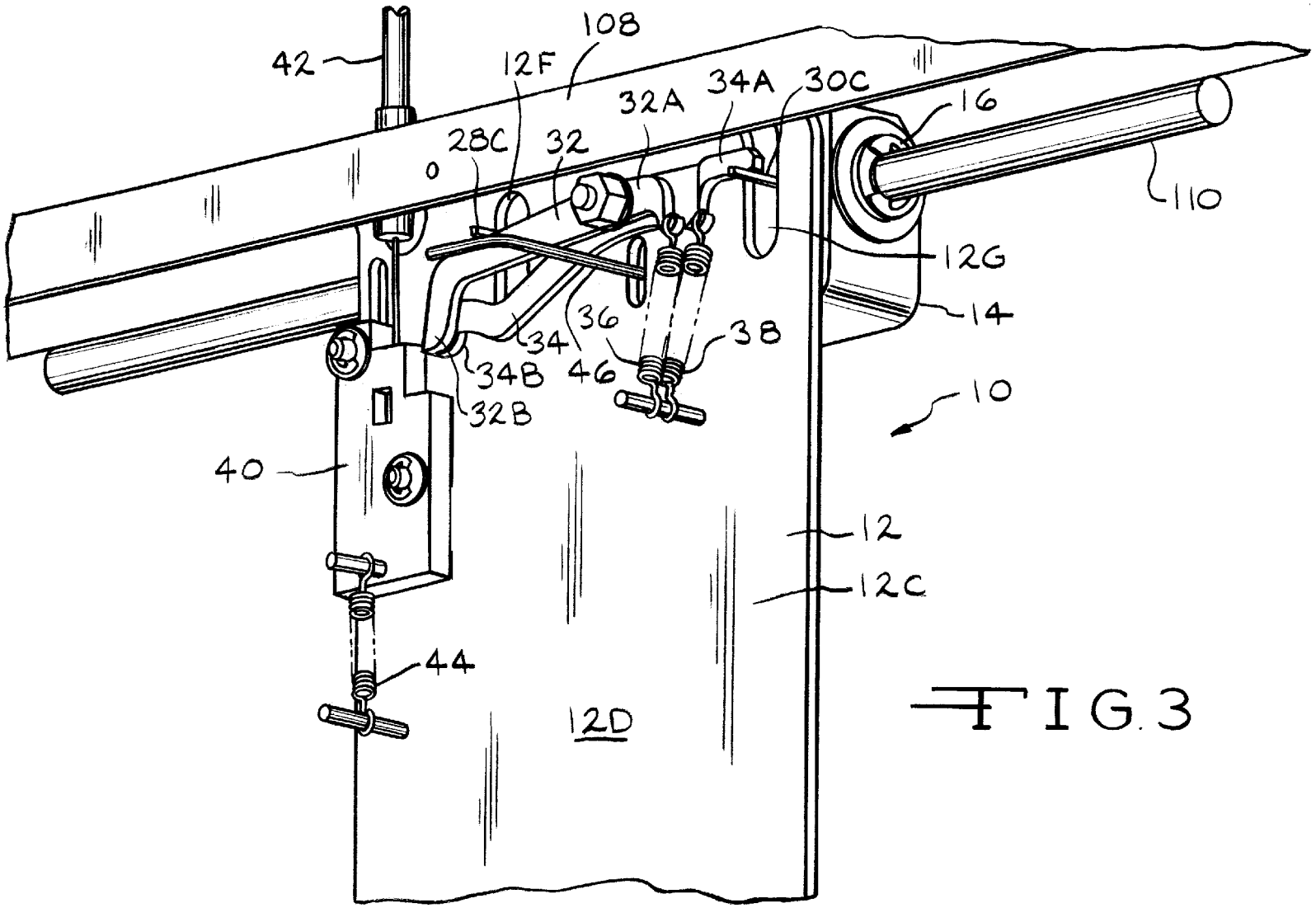
FIG. 3 is a front perspective view of the front side 12D of the housing plate 12 mounted to the kick plate 108 and showing the release block 40, in the lock position and the first and second release levers 32 and 34 in the release position.
Figure 4:
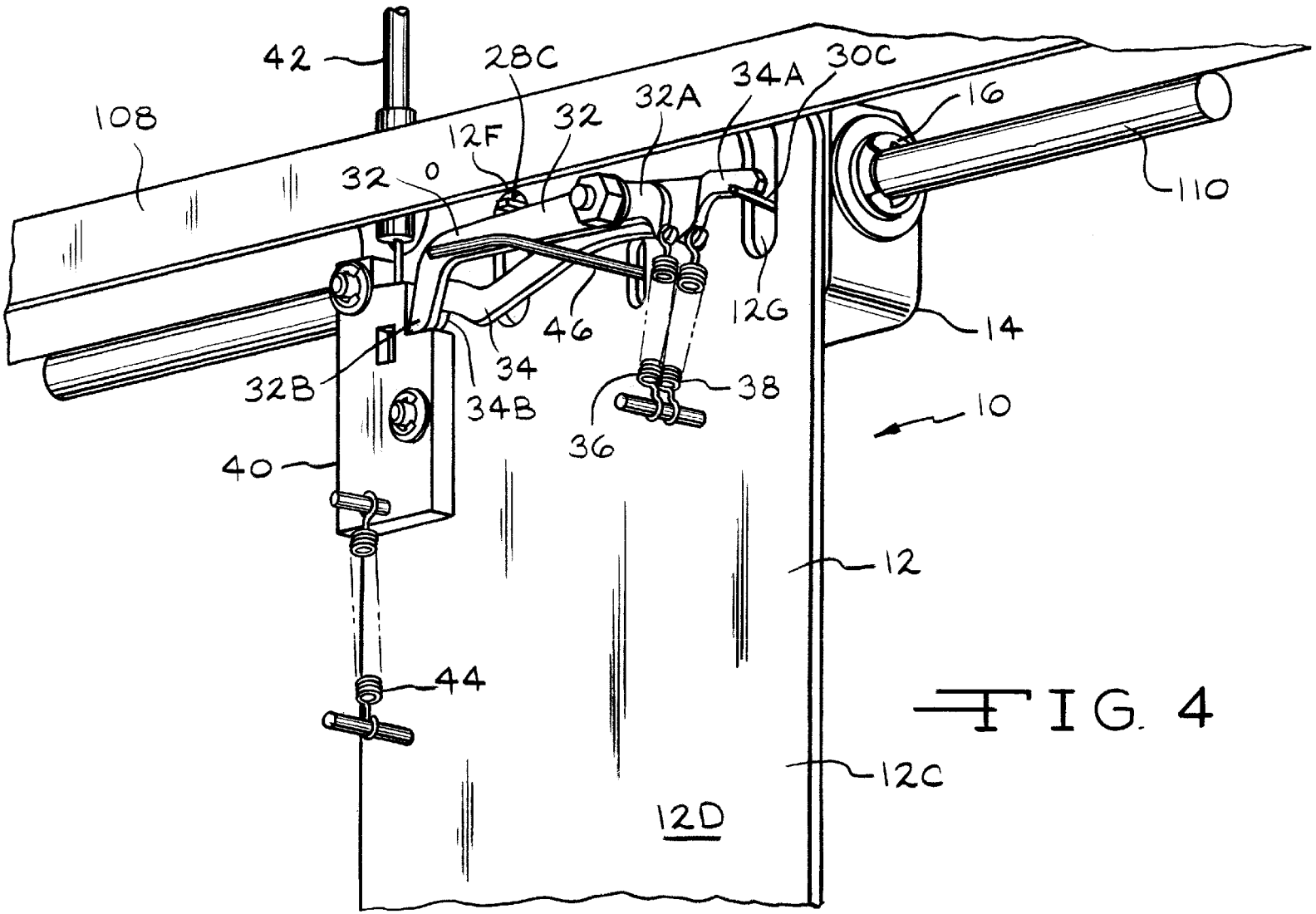
FIG. 4 is a front perspective view of the front side 12D of the housing plate 12 mounted to the kick plate 108 showing the release block 40 in the unlock position in contact with the first and second release levers 32 and 34.

In normal operation, when the work surface 102 is at rest with no out-of-balance load applied to the workstation 100, the first and second release levers 32 and 34 are in the non-load or release position (FIG. 3). In this position, the first and second wrap springs 28 and 30 are wrapped tightly around the second portion 20B and 22B of the first and second fixed hubs 20 and 22 to prevent rotation of the fixed hubs 20 and 22 and shaft 110 in both directions. To move the work surface 102, the main release lever 42 is pulled or otherwise activated. When the main release lever 42 is pulled, the release block 40 moves upward toward the top flange 12A of the housing plate 12 from the lock position to the unlock position. As the release block 40 moves upward, the front side 12D of the release block 40 contacts the second ends 32B and 34B of the release levers 32 and 34 which acts to pivot the release levers into contact with the tangs 28C and 30C at the first ends 28A and 30A of the first and second wrap springs 28 and 30 (FIG. 4). In the preferred embodiment, when the first and second release levers 32 and 34 are in the release positions, the second ends 32B and 34B of the first and second release levers 32 and 34 are positioned together such that the front side 12D of the release block 40 contacts the release levers at the same time and such that the first and second wrap springs 28 and 30 are released simultaneously. In the preferred embodiment, the top edge of the second end 32B of the first release lever 32 contacts and pushes the tang 28C at the first end 28A of the first wrap spring 28 upward which unwraps the first end 28A of the first wrap spring 28 from around the second portion 20B of the first fixed hub 20 such that the inner diameter of the first wrap spring 28 at the first end 28A is increased and the first fixed hub 20 is able to rotate freely within the first wrap spring 28. Preferably, the bottom edge of the second end 34B of the second release lever 34 contacts and pushes the tang 30C at the first end 30A of the second wrap spring 30 downward which unwraps the 30A of the second wrap spring 30 from around the second portion 22B of the second fixed hub 22 such that the inner diameter of the second wrap spring 30 at the first end 30A is increased and the second fixed hub 22 is able to rotate freely within the second wrap spring 30. The release levers 20 and 22 act on the first ends 28A and 30A of both the first and second wrap springs 28 and 30 in opposite directions to unwind both the first and second wrap springs 28 and 30, thus allowing the first and second fixed hubs 20 and 22 to rotate and allowing the shaft 110 to rotate in either direction. Once the release block 40 has been moved into the unlock position or upward position, the shaft 110 is free to rotate in either direction such as to raise or lower the work surface 102. In the preferred embodiment, the user continues to pull the main release lever 42 until the work surface 102 has been adjusted. When the work surface 102 is at the correct height, the main release lever 42 is released or deactivated. When the main release lever 42 is no longer being pulled, the biasing means 44 on the release block 40, the springs 36 and 38 and, release levers 20 and 22 act to move the release block 40 and release levers 20 and 22 back into the lock position and release position, respectively.

Figure 5:
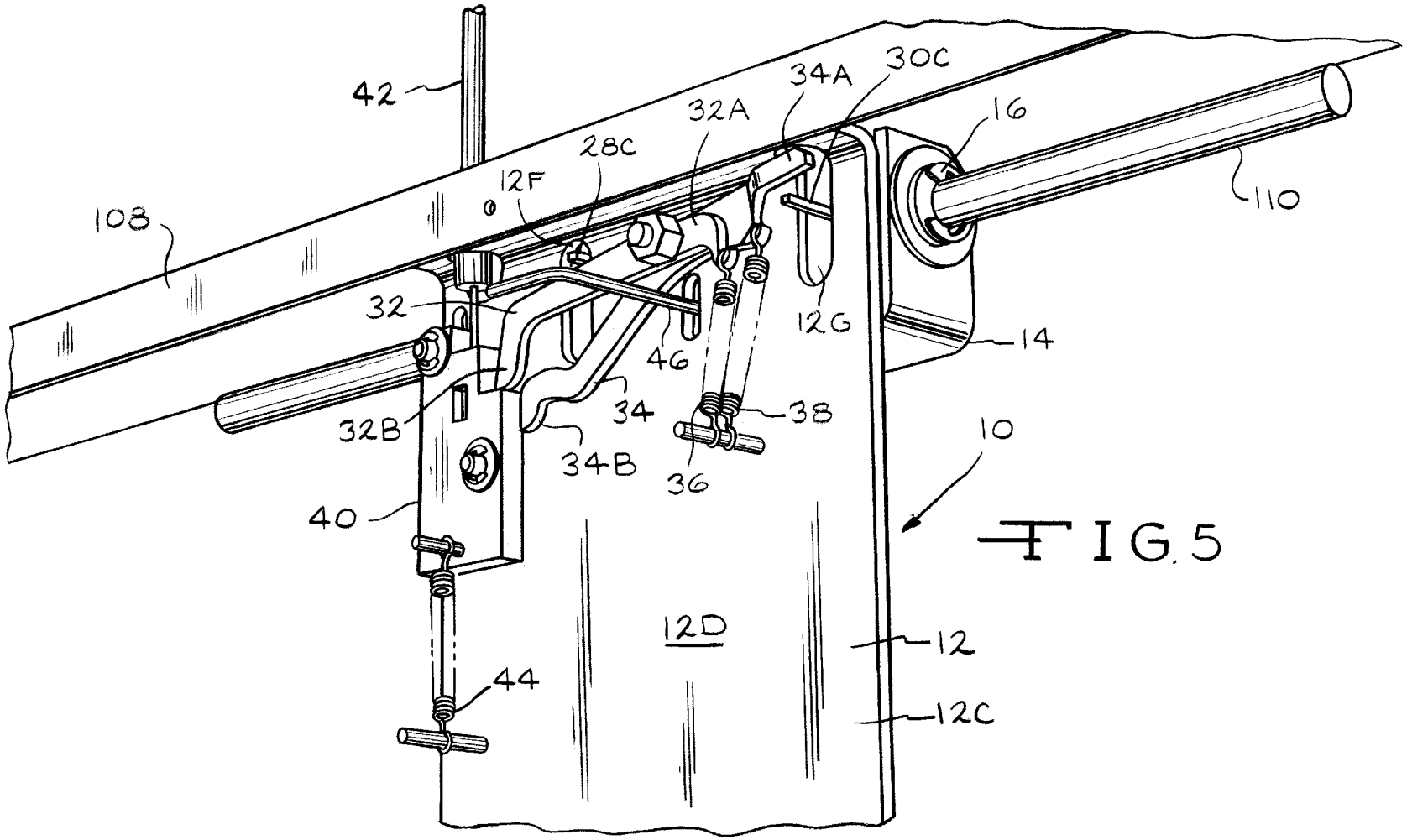
FIG. 5 is a front perspective view of the front side 12D of the housing plate 12 mounted to the kick plate 108 showing the release block 40 in the unlock position in contact with the first release lever 32 and showing the second release lever 34 in the non-release, out-of-balance position.
Figure 6:
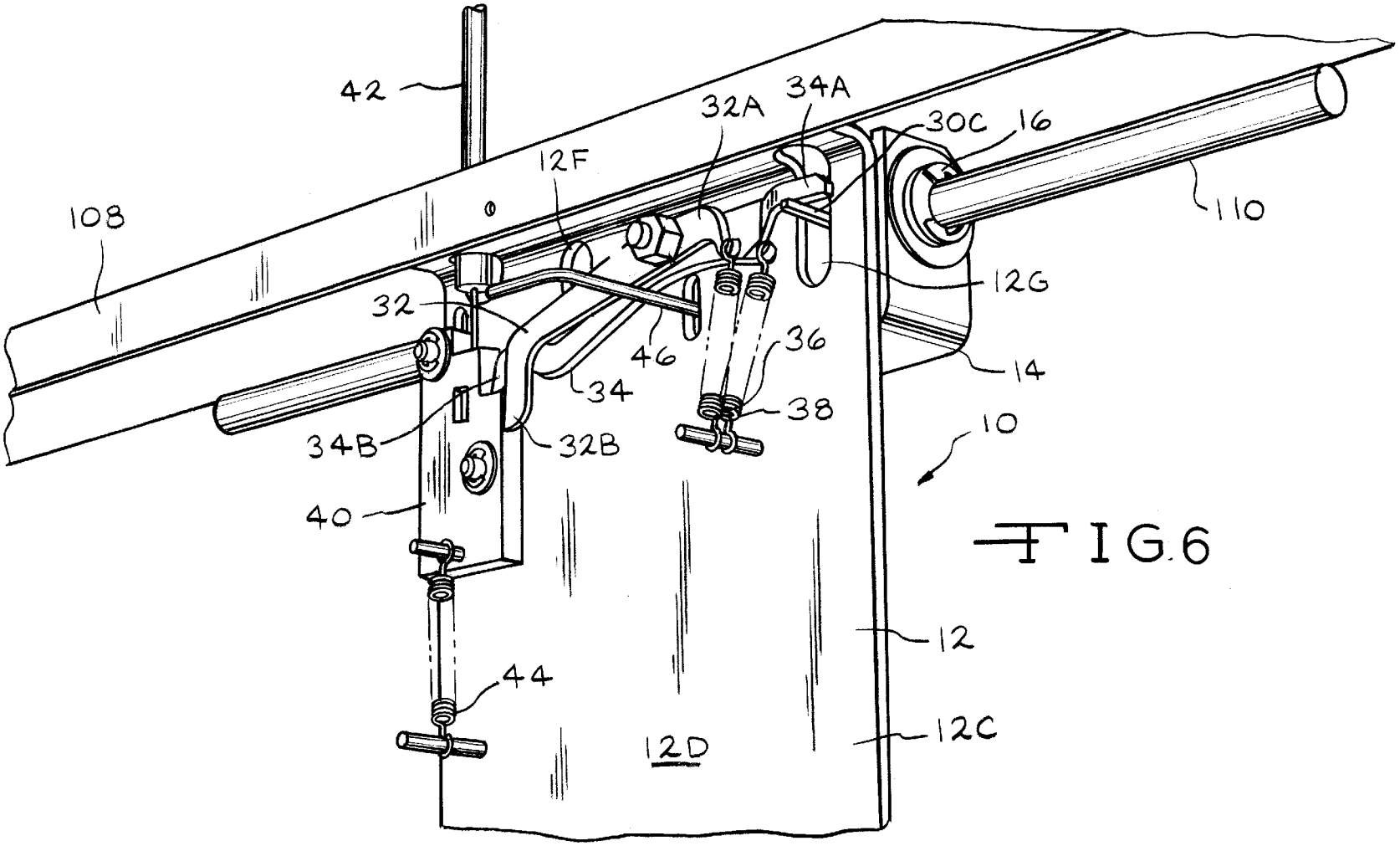
FIG. 6 is a front perspective view of the front side 12D of the housing plate 12 mounted to the kick plate 108 showing the release block 40 in the unlocked position in contact with the second release lever 34, and showing the first release lever 32 in the non-release, out-of-balance position.
Figure 7:
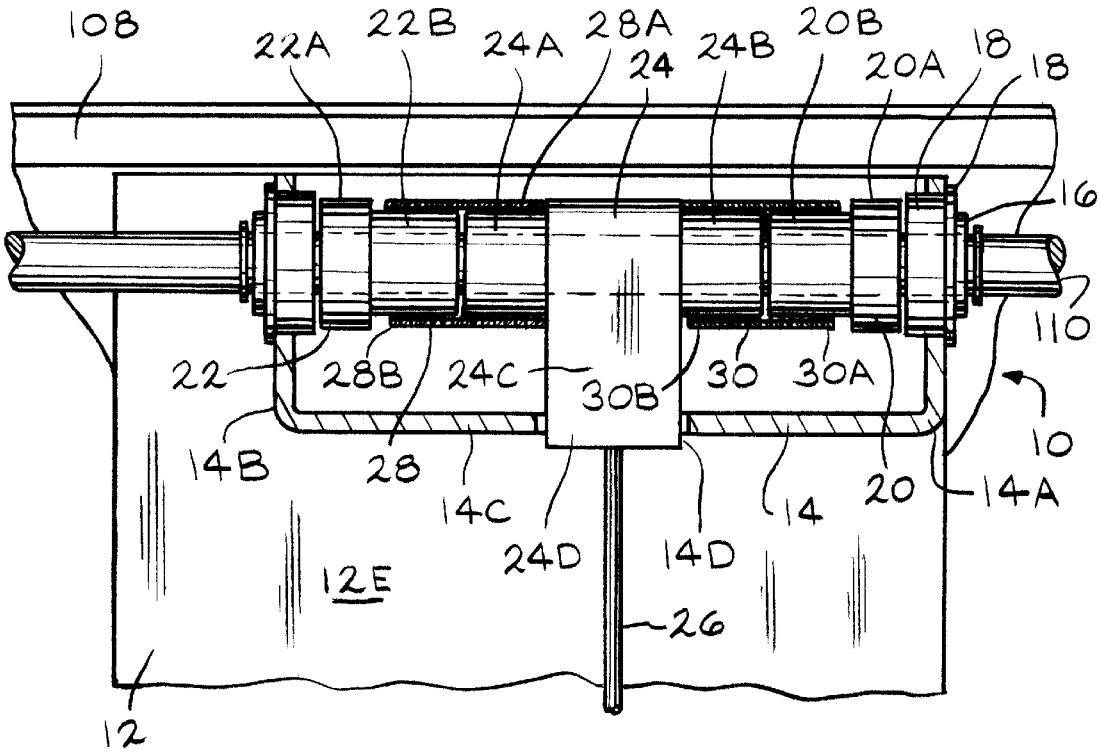
FIG. 7 is a partial, cross-sectional view of the back side 12E of the housing plate 12 showing the mounting bracket 14, the fixed hubs 20 and 22 and the rotatable hub 24.
Figure 8:
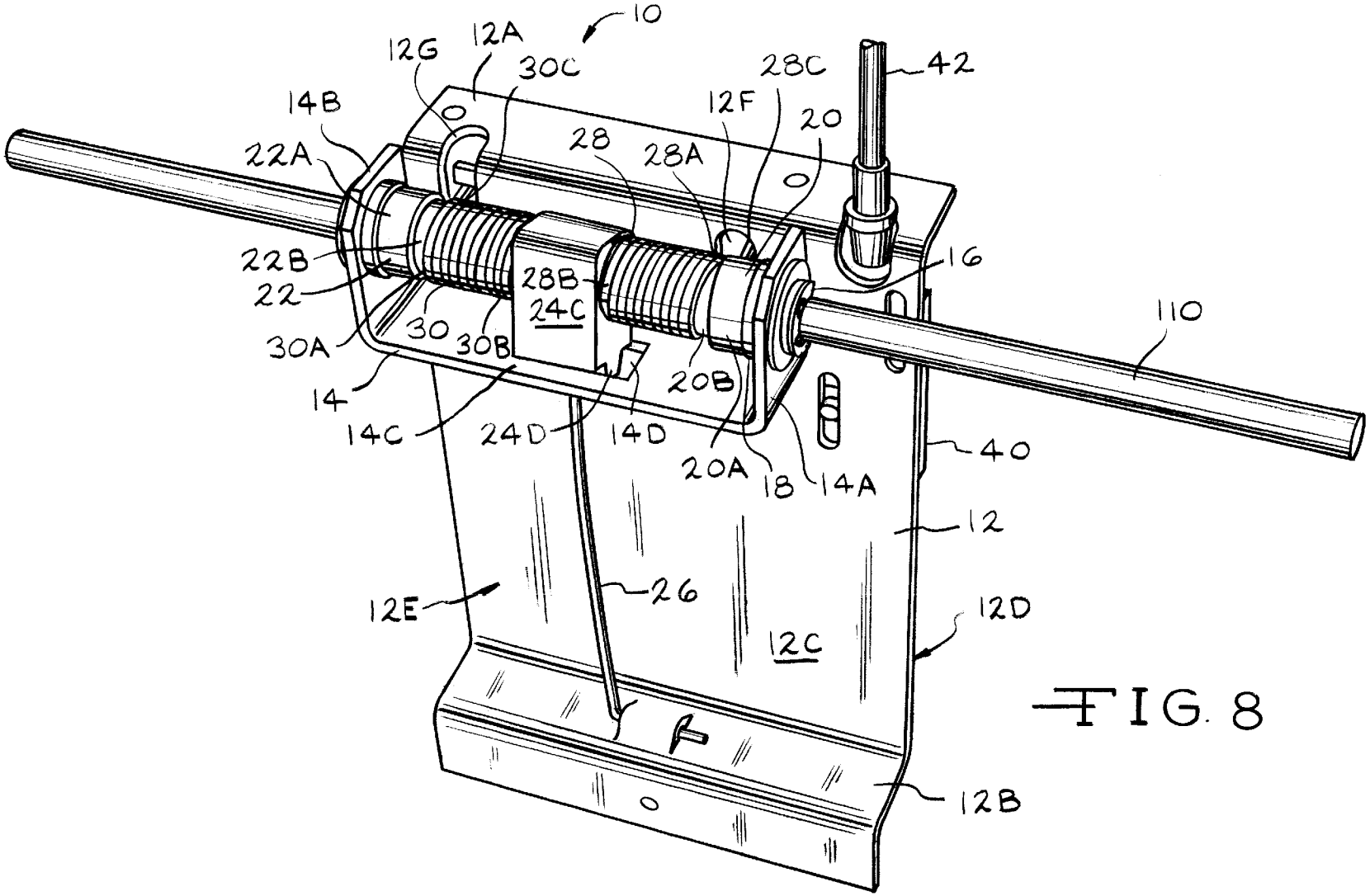
FIG. 8 is a rear perspective view of the back side 12E of the housing plate 12 showing the shaft 110 in the out-of-balance position with the extension 24D of the rotatable hub 24 in contact with the first stop.

In a situation where a load or less load (out-of-balance) is applied to the work surface 102, the device 10 may or may not allow for movement of the work surface 102 in both directions depending on the amount of torque applied to the shaft 110 which is directly proportional to the amount of out-of-balance load applied to the work surface 102. The load can be applied either to raise or lower the work surface 102. When the work surface 102 is at rest in a fixed position with the main release lever 42 not activated or pulled and an out-of-balance load is applied to the work surface 102, the load applies a torque to the shaft 110 attempting to rotate the shaft 110, first and second fixed hubs 20 and 22, the first and second wrap springs 28 and 30 and the rotatable hub 24. The spring wire 26 connected to the extension 24D of the rotatable hub 24 counteracts and resists the torque attempting to rotate the shaft 110. Thus, increasing the amount of torque needed to rotate the shaft 110. By varying the length of the spring wire 26, the amount of force needed to be applied to the spring wire 26 to deflect the spring wire 26 and allow the rotatable hub 24 to move is varied. Thus, the amount of torque needed to be applied to the shaft 110 is varied and the amount of out-of-balance load needed to be applied to the work surface 102 to move the release levers 20 and 22 to the non-release position is varied. In the preferred embodiment, the shorter the spring wire 26 the greater the out-of-balance load needed to be applied to the work surface 102 to rotate the shaft 110 and rotatable hub 24 and move the first or second release lever 20 or 22 to the non-release position. In one (1) embodiment, the length of the spring wire 26 can be adjustable to allow an out-of-balance load of between 25 lbs and 35 lbs. In one (1) embodiment, the release levers 20 and 22 moves into the non-release position before the rotatable hub 24 is fully rotated into the first or second stop. The rotatable hub 24 will rotate until the rotatable hub 24 is fully rotated into contact with one of the edges of the opening 14D acting as the first and second stop in the center portion 14C of the mounting bracket 14. The first or second stop acts as a safety mechanism and prevents further rotation of the rotatable hub 24 and the shaft 110 which prevents damage to the device; particularly, the spring wire 26. In the preferred embodiment, when a torque of greater than approximately 17 inches-pounds is applied to the shaft 110, the rotatable hub 24 is fully rotated with the extension 24D in contact with the first or second stop. Preferably, the shaft 110 is able to rotate approximately 7.5° before the extension 24D of the rotatable hub 24 encounters the first or second stop. The direction of applied torque depends on the direction of the force applied to the work surface 102 (upward or downward). The direction of rotation of the rotatable hub 24 and the direction of movement of the extension 24D of the rotatable hub 24 depends on the direction of the force applied to the work surface 102. In one (1) embodiment the first and second stops are positioned such as to allow essentially the same amount of rotation of the rotatable hub 24 in either direction. However, it is understood that the first and second stops can be positioned such as to allow greater movement in one (1) direction before the rotatable hub 24 reaches the first or second stop and prevents further rotation of the shaft 110. As the rotatable hub 24 rotates, the wrap springs 28 and 30 rotate and the tangs 28C and 30C at the first ends 28A and 30A of the wrap springs 28 and 30 extending through the slots 12F and 12G in the housing plate 12 move. The first ends 28A and 30A of the wrap springs 28 and 30 move in the same direction either up or down, depending on the direction of rotation of the shaft 110. In the embodiment using two (2) release levers, only one (1) release lever is moved, depending on the direction the shaft 110 is rotated which depends on the direction of the out-of-balance load applied to the work surface 102. Thus, one (1) lever moves into the non-release position while the other lever remains in the release position. Due to the positioning of the first ends 28A and 30A of the first and second wrap springs 28 and 30 with regard to the first and second release levers 32 and 34, when the first ends 28A and 30A of the wrap springs 28 and 30 move downward, only the first end 28A of the first wrap spring 28 contacts the first release lever 32 and moves the first release lever 32 into the non-release position. The first end 30A of the second wrap spring 30 does not move the second release lever 34. In contrast, when the shaft 110 is rotated in the opposite direction and the tangs 28C and 30C at the first ends 28A and 30A of the first and second wrap springs 28 and 30 are moved upward, the first end 30A of the second wrap spring 30 contacts the second release lever 34 and moves the second release lever 34 into the non-release position. However, the first end 28A of the first wrap spring 28 does not contact the first release lever 28. When the amount of torque tending to rotate the shaft 110 reaches a set amount such that the force applied to the work surface 102 exceeds a certain amount, the first or second wrap spring 28 or 30 has rotated such a distance as to have moved the first or second lever 32 or 34 such that the first end 32A or 34A of one (1) of the release levers 32 or 34 adjacent the release block 40 is in the non-release position (FIGS. 5 and 6). In the non-release position, the second end 32B or 34B of the release lever 32 or 34 is moved downward toward the bottom flange 12B of the housing plate 12 so that the second end 32B or 34B of the release lever 32 or 34 is not in the path of movement of the release block 40. When the one (1) release lever 32 or 34 is in the non-release position and the main release lever 42 is pulled, the release block 40 slides upward from the lock position to the unlock position and does not contact the release lever 32 or 34 in the non-release position. However, the release block 40 will contact the other release lever 32 or 34 in the release position (FIGS. 5 and 6). Thus, the release lever 32 or 34 in the non-release position will not move and will not contact the wrap spring 28 or 30 to unwind the wrap spring 28 or 30 to release the shaft 110. Consequently, the work surface 102 can not be moved in the direction of the applied out-of-balance force. In the preferred embodiment, the amount of torque needed to pivot the release levers 32 or 34 is less than the predetermined amount of torque needed to rotate the rotatable hub 24 into the first or second stop. The device 10 prevents a user from releasing or unlocking the device 10 and allowing movement of the work surface 102 when an additional load is applied to the work surface 102 and the work surface 102 is out-of-balance. This prevents the work surface 102 from moving too quickly in either direction due to an extra applied load.

It is intended that the foregoing description be only illustrative of the present invention and that the present invention be limited only by the hereinafter appended claims.

I claim:

1. A device for controlling rotation of a shaft, which comprises:

(a) a fixed hub fixably mounted on the shaft;

(b) a rotatable hub rotatably mounted on the shaft;

(c) a wrap spring releasably mounted around the fixed hub and the rotatable hub;

(d) a stop mounted adjacent the rotatable hub to limit rotation of the rotatable hub;

(e) a release lever movably mounted adjacent the wrap spring such that the release lever is in contact with the wrap spring wherein movement of the wrap spring moves the release lever from a release position to a non-release position; and (f) a release block slidably mounted adjacent the release lever wherein when the release lever is in the release position and the release block is moved from a lock position into an unlock position, the release block contacts the release lever and moves the release lever such that the release lever moves the wrap spring so as to release the wrap spring from around the fixed hub, wherein when the release lever is in the non-release position and the release block is moved from the lock position, the release block does not contact the release lever to release the wrap spring from around the fixed hub.

2. The device of claim 1 wherein a spring wire having opposed ends is connected at one end to the rotatable hub and fixably mounted at the other end such as to resist rotation of the rotatable hub and the shaft.

3. The device of claim 2 wherein the spring wire applies a resistive force to the rotatable hub such that the spring wire resists rotation of the rotatable hub.

4. The device of claim 1 wherein a biasing means is provided on the release lever to bias the release lever into the release position.

5. The device of claim 1 wherein a biasing means is provided on the release block to bias the release block into the lock position.

6. A device for controlling rotation of a shaft, which comprises:

(a) a first fixed hub fixably mounted on the shaft;

(b) a second fixed hub fixably mounted on the shaft;

(c) a rotatable hub rotatably mounted on the shaft;

(d) a first wrap spring mounted around the first fixed hub and the rotatable hub;

(e) a second wrap spring mounted around the second fixed hub and the rotatable hub;

(f) a first stop mounted adjacent the rotatable hub to limit rotation of the rotatable hub in a first direction;

(g) a second stop mounted adjacent the rotatable hub to limit rotation of the rotatable hub in a second direction opposite from the first direction;

(h) a release lever movably mounted adjacent the first and second wrap springs such that the release lever is in contact with the first wrap spring and the second wrap spring, wherein movement of the first wrap spring moves the release lever from a first release position to a first non-release position and wherein movement of the second wrap spring moves the release lever from a second release position to a second non-release position; and (i) a release block slidably mounted adjacent the release lever wherein when the release lever is in the first release position and the release block is moved from a lock position into an unlock position, the release block will contact the release lever and will move the release lever such that the release lever will move the first wrap spring so as to release the first wrap spring, and wherein when the release lever is in the second release position and the release block is moved from the lock position into the unlock position, the release block will contact the release lever and will move the release lever so that the release lever will move the second wrap spring so as to release the second wrap spring, wherein when the release lever is in the first non-release position and the release block is moved from the lock position into the unlock position, the release block will not contact the release lever to release the first wrap spring and wherein when the release lever is in the second non-release position and the release block is moved from the lock position into the unlock position, the release block will not contact the release lever to release the second wrap spring.

7. The device of claim 6 wherein the rotatable hub includes a first rotatable hub and a second rotatable hub.

8. The device of claim 6 wherein a spring wire having opposed ends is connected at one end to the rotatable hub and wherein the other end of the spring wire is fixably mounted with respect to the shaft such as to resist rotation of the rotatable hub and the shaft.

9. The device of claim 8 wherein the spring wire applies a resistive force to the rotatable hub such that the spring wire resists rotation of the rotatable hub.

10. The device of claim 6 wherein an out-of-balance indicator lever is mounted on the rotatable hub and indicates when the shaft has been rotated while the release block is in the lock position.

11. The device of claim 6 wherein a block biasing means is connected to the release block to bias the release block into the lock position.

12. The device of claim 6 wherein the first stop is positioned such that the shaft is able to rotate a predetermined amount in the first direction before the rotatable hub will contact the first stop and prevent further rotation of the shaft.

13. The device of claim 6 wherein the second stop is positioned such that the shaft is able to rotate a predetermined amount in the second direction before the rotatable hub will contact the second stop and prevent further rotation of the shaft.

14. The device of claim 6 wherein the release lever includes a first release lever and a second release lever, wherein the first release lever is in contact with the first wrap spring, wherein the second release lever is in contact with the second wrap spring, wherein movement of the first wrap spring will move the first release lever from a first release position to a first non-release position, and wherein movement in the second wrap spring will move the second release lever from a second release position to a second non-release position.

15. The device of claim 14 wherein a first biasing means is connected to the first release lever to bias the first release lever into the first release position.

16. The device of claim 14 wherein a second biasing means is provided on the second release lever to bias the second release lever into the second release position.

17. The device of claim 6 wherein the first wrap spring has opposed first and second ends with the first end releasably mounted around the first fixed hub and second end fixably mounted around the rotatable hub.

18. The device of claim 17 wherein the release lever includes a first release lever and a second release lever, wherein the first release lever is in contact with the first end of the first wrap spring wherein when the first release lever is in the release position and the release block is moved from the lock position to the unlock position, the first release lever will move the first end of the first wrap spring and will unwrap the first wrap spring from around the first fixed hub such that when the shaft rotates, the first fixed hub rotates within the first wrap spring.

19. The device of claim 6 wherein the second wrap has opposed first and second ends with the first end releasably mounted around the second fixed hub and the second end fixably mounted around the second rotatable hub.

20. The device of claim 19 wherein the release lever includes a first release and a second release lever, wherein the second release lever is in contact with the first end of the second wrap spring wherein when the second release lever is in the release position and the release block is moved from the lock position to the unlock position, the second release lever will move the first end of the second wrap spring and will unwrap the second wrap spring from around the second fixed hub such that when the shaft rotates, the second fixed hub rotates within the second wrap spring.

21. A device for controlling movement of a work surface of a workstation, the workstation having at least one movement mechanism having a shaft which rotates during movement of the work surface of the workstation, which comprises:

(a) a housing plate mounted to the workstation adjacent the shaft having a front side and a back side and a first and second opening;

(b) a mounting bracket having first and second ends and mounted on the back side of the housing plate such that the first and second openings are spaced between the first and second ends of the mounting bracket wherein the first and second ends of the mounting bracket have first and second holes through which the shaft is rotatably mounted;

(c) a first fixed hub fixably mounted on the shaft between the ends of the mounting bracket;

(d) a second fixed hub fixably mounted on the shaft between the ends of the mounting bracket;

(e) a rotatable hub rotatably mounted on the shaft between the ends of the mounting bracket;

(f) a first wrap spring having first and second ends and mounted at the first end on the first fixed hub and fixably mounted at the second end on the rotatable hub wherein the first end of the first wrap spring extends through the first opening in the housing plate;

(g) a second wrap spring having first and second ends and mounted at the first end on the second fixed hub and fixably mounted at the second end to the rotatable hub wherein the first end of the second wrap spring extends through the second opening in the housing plate;

(h) a first stop mounted adjacent the rotatable hub to limit rotation of the rotatable hub in a first direction;

(i) a second stop mounted adjacent the rotatable hub to limit rotation of the rotatable hub in a second direction;

(j) a first release lever having first and second ends pivotably mounted on the front side of the housing plate so that the second end of the first release lever is adjacent the first opening in the housing plate and is in contact with the first end of the first wrap spring wherein movement of the first end of the first wrap spring moves the first release lever from a release position to a non-release position;

(k) a second release lever having a first end and a second end and pivotably mounted on the front side of the housing plate so that the first end of the second release lever is adjacent the second opening in the housing plate and is in contact with the second end of the second wrap spring wherein movement of the first end of the second wrap spring moves the second release lever from a release position to a non-release position; and (l) a release block slidably mounted on the front side of the housing plate adjacent the second end of the first release lever and the second end of the second release lever wherein when the first release lever is in the release position, and the release block is moved from a lock position to an unlock position, the release block will contact the second end of the first release lever and will pivot the first release lever such that the first release lever will unwrap the first end of the first wrap spring so as to release the first wrap spring from around the first fixed hub, and wherein when the second release lever is in the release position and the release block is moved from the lock position to the unlock position, the release block will contact the second end of the second release lever and will pivot the second release lever so that the second release lever will unwrap the second end of the second wrap spring so as to release the second wrap spring from around the second fixed hub, wherein when the first release lever is in the non-release position, and the release block is moved from the lock position to the unlock position, the release block will not contact the first release lever to release the first wrap spring and wherein when the second release lever is in the non-release position and the release block is moved from the lock position to the unlock position, the release block will not contact the second release lever to release the second wrap spring.

22. The device of claim 21 wherein the rotatable hub includes a first rotatable hub and a second rotatable hub.

23. The device of claim 21 wherein the rotatable hub has an extension portion which contacts the first stop to limit rotation of the rotatable hub in the direction and contacts the second stop to limit rotation of the single rotatable hub in the second direction.

24. The device of claim 21 wherein a spring wire is connected at one end to the rotatable hub and wherein the other end of the spring wire is fixably mounted to the housing plate such as to resist rotation of the rotatable hub.

25. The device of claim 24 wherein the spring wire applies a resistive force to the rotatable hub such that the spring wire resists rotation of the rotatable hub.

26. The device of claim 21 wherein a center portion of the mounting bracket has an opening and wherein the rotatable hub has an extension portion which extends through the opening in the center portion of the mounting bracket and wherein sides of the opening act as the first and second stops for the rotatable hub.

27. The device of claim 21 wherein an out-of-balance indicator lever is mounted on the rotatable hub and wherein when the shaft rotates while the release block is in the lock position, the out-of-balance indicator lever indicates that the shaft is out-of-balance.

28. The device of claim 21 wherein a biasing means is provided on the first release lever to bias the first release lever into the release position.

29. The device of claim 21 wherein a biasing means is provided on the second release lever to bias the second release lever into the release position.

30. The device of claim 21 wherein a biasing means is provided on the release block to bias the release block into the lock position.

31. The device of claim 21 wherein the first stop is positioned so that the shaft is able to rotate approximately 7.5° in the first direction before the rotatable hub contacts the first stop and prevents further rotation of the shaft.

32. The device of claim 21 wherein the second stop is positioned so that the shaft is able to rotate approximately 7.5° in the second direction before the rotatable hub contacts the second stop and prevents further rotation of the shaft.

* * * * *